US008256513B2

(12) United States Patent
Picou

(10) Patent No.: US 8,256,513 B2
(45) **Date of Patent: *Sep. 4, 2012**

(54) APPARATUS FOR DEPOSITING A SLURRY IN A WELL

(76) Inventor: Robert A. Picou, Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/238,454

(22) Filed: Sep. 21, 2011

(65) Prior Publication Data

US 2012/0006544 A1 Jan. 12, 2012

Related U.S. Application Data

(63) Continuation of application No. 12/274,416, filed on Nov. 20, 2008, now Pat. No. 8,113,282.

(51) Int. Cl.
*E21B 43/04* (2006.01)

(52) U.S. Cl. ..... 166/278; 166/51; 166/168

(58) Field of Classification Search ..... 166/278, 166/51, 168

See application file for complete search history.

(56) References Cited

U.S. PATENT DOCUMENTS

| | | | |
|---|---|---|---|
| 2,526,021 | A | 10/1950 | Fultz |
| 2,695,065 | A | 11/1954 | Baker et al. |
| 2,707,998 | A | 5/1955 | Baker et al. |
| 2,896,714 | A | 7/1959 | Killingsworth |
| 4,739,829 | A | 4/1988 | Brunner |
| 5,033,549 | A | 7/1991 | Champeaux et al. |
| 5,115,860 | A | 5/1992 | Champeaux et al. |
| 5,411,090 | A | 5/1995 | Cornette et al. |
| 6,230,802 | B1 | 5/2001 | Duhon |

OTHER PUBLICATIONS

Applicant's co-pending parent U.S. Appl. No. 12/274,416, filed Nov. 20, 2008.

*Primary Examiner* — Nicole Coy
(74) *Attorney, Agent, or Firm* — Jones Walker

(57) ABSTRACT

A wireline apparatus for depositing slurry in a well. The apparatus includes a container for holding slurry to be deposited in the well. The container is operatively associated with and disassociated from a packer. The apparatus also includes a displacement valve actuated by a predetermined pressure and a cross-over tool operatively associated with the displacement valve. Actuation of the displacement valve causes the slurry to enter and pass through the cross-over tool and into the well. A method of gravel packing a well with the wireline deployed apparatus is also disclosed.

19 Claims, 17 Drawing Sheets

APPARATUS FOR DEPOSITING A SLURRY IN A WELL

CROSS-REFERENCE TO RELATED APPLICATIONS

This application is a continuation of and claims priority to U.S. patent application Ser. No. 12/274,416, filed Nov. 20, 2008 now U.S. Pat. No. 8,113,282.

BACKGROUND OF THE INVENTION

The present invention relates to an apparatus and method for depositing a slurry in a well and more particularly, to a wireline deployed apparatus and method for depositing a slurry in a hydrocarbon well.

Operators complete wells to subterranean reservoirs to produce hydrocarbon. The completed wells may have gravel-pack systems to keep the well from producing sand and other reservoir particles during the well's life. Those of ordinary skill in the art will appreciate that the production of reservoir sand can lead to significant problems including costly and dangerous equipment failure. Operators have used gravel-packing techniques to control the production of sand.

Over the years, many different gravel-packing techniques and methods have been devised. One procedure has been to use either jointed pipe or coiled tubing to perform the gravel-packing procedures. Gravel packing with jointed pipe and coiled tubing require the use of specialized deployment mechanisms such as a rig or coiled tubing unit that are expensive and result in a large foot print of equipment.

Conventional dump bailers used to deposit slurry in a well suffer from deficiencies in proppant placement. Such deficiencies can result in poor perforation filling and inflow performance.

SUMMARY OF THE INVENTION

It is an object of the present invention to provide a high-rate slurry displacement.

It is a further object of the present invention to provide an enhanced proppant placement for perforation and inflow performance.

It is a further object of the present invention to provide an economical slurry-depositing apparatus and method.

It is a further object of the present invention to provide a slurry-depositing apparatus and method that provides a small equipment foot print.

The objects of the present invention are achieved by a novel wireline apparatus for depositing a slurry in a well. The wireline apparatus may include a container. The container may have a first end, a second end, an outer portion, and an inner portion. The inner portion of the container may be capable of containing slurry to be deposited in the well. The second end of the container may be capable of being operatively attached to and detached from a packer. The wireline apparatus may also include a displacement valve. The displacement valve may be positioned at the second end of the container. The displacement valve may be actuated by a predetermined fluid pressure applied thereto. The wireline apparatus may also include a cross-over tool. The cross-over tool may be operatively associated with the displacement valve. The cross-over tool may have an outer portion, an inner portion, and at least one port. Actuation of the displacement valve causes the slurry in the inner portion of the container to enter the inner portion of the cross-over tool and pass through the at least one port to the outer portion of the cross-over tool and into the well.

The displacement valve may be a piston. The piston may be held in place by a holding means. The holding means may be at least one shear pin. The piston may be actuated by a shearing of the at least one shear pin when a predetermined fluid pressure is applied to the piston. Alternatively, the displacement valve may be a check valve such as a spring-loaded check valve.

The first end of the container may have at least one port. The port may be capable of causing fluid pressure in the well to be exerted on the slurry contained within the inner portion of the container.

The second end of the container may include an anchor assembly. The anchor assembly may be capable of operatively attaching to and detaching from the packer. The anchor assembly may include at least one latching prong. The anchor assembly may alternatively be a seal assembly such as a locator seal assembly.

The packer may include an inner bore and a sliding-sleeve valve positioned therein. The sliding-sleeve valve may have an opened and a closed position. The wireline apparatus may further include a shifting tool positioned on the outer portion of the cross-over tool. The shifting tool may be capable of actuating the sliding-sleeve valve to the opened position when the second end of the container is operatively attached to the packer and capable of actuating the sliding-sleeve to the closed position when the second end of the container is operatively detached from the packer.

The cross-over tool may include an upper seal and a lower seal. The upper seal may be capable of sealingly engaging with the inner bore of the packer. The lower seal may be capable of sealingly engaging with the sliding-sleeve valve. Alternatively, the packer may include a seal and the sliding-sleeve valve may include a seal. Each seal is capable of sealingly engaging with the cross-over tool.

In an alternative embodiment of the wireline apparatus, the first end of the container may include a first check valve for allowing fluid flow into the inner portion of the container and a second check valve for allowing fluid flow out of the inner portion of the container. In this embodiment, the inner portion of the container may also include a first chamber and a second chamber. The first and second chambers may be separated by a movable piston. The second chamber may be operable to contain the slurry for deposit in the well.

The container may be cylindrical. The cylindrical container may be adapted to be run into the well on wireline. The wireline may be an electric line capable of transmitting an electrical signal. The wireline may also be a slickline cable.

The slurry to be deposited in the well may be a surfactant, acid, polymer, resin, sealant, gravel pack slurry or any combination thereof.

The packer may be a gravel-pack packer sealingly engaging an internal bore of a production packer, production tubing or casing disposed in the well.

In another alternative embodiment of the wireline apparatus, a packer may sealingly engage the well. The packer may have an inner bore with a circulation valve disposed therein. The circulation valve may have an inner portion and an outer portion. The circulation valve may also have an opened position and a closed position.

This alternative embodiment may include a slurry-depositing assembly. The slurry-depositing assembly may be configured to be concentrically disposed within the inner bore of the packer. The slurry-depositing assembly may be capable of being operatively attached to and detached from the packer.

The slurry-depositing assembly of this alternative embodiment may include a container sub. The container sub may have a first end, a second end, an inner portion and an outer portion. The first end of the container sub may have a fishing neck for deploying and retrieving the slurry-depositing assembly using a wireline. The inner portion may contain the slurry for deposit into the well. A top sub may be operatively attached to the second end of the container sub. The top sub may have a first end, a second end, an outer portion, and an inner portion. The inner portion may include a piston. The piston may be held in place with at least one shear pin. The piston may be actuated by shearing of the at least one shear pin when a predetermined fluid pressure is applied to the piston. A spacer joint may be operatively attached to the second end of the top sub. The spacer joint may have a first end, a second end, an outer portion, and an inner portion. A shifter member may be operatively attached to the outer portion of the spacer joint at the second end thereof. The shifter member may have a first end, a second end, an outer portion and an inner portion. The outer portion of the shifter member may be configured to operatively engage the inner portion of the circulation valve.

The packer may have an internal profile for cooperative engagement with the outer portion of the circulation valve.

The shifter member may contain an outer shoulder configured to engage an inner shoulder of the circulation valve to shift the circulation valve from the closed position to the opened position.

The piston may include at least one seal. The at least one seal may sealingly engage with the inner portion of the top sub when the piston is positioned therein. The piston may be capable of moving from the inner portion of the top sub, through the inner portion of the spacer joint, to the inner portion of the shifter member upon actuation of the piston.

The at least one seal of the piston may also be capable of sealingly engaging with the inner portion of the shifter member when the piston is positioned therein.

In this alternative embodiment, the slurry-depositing assembly may include a latch assembly. The latch assembly may be partially positioned on the outer portion of the top sub at the second end thereof. The latch assembly may be operable to selectively attach and detach the top sub to the inner bore of the packer. The latch assembly may include a collet disposed on the outer portion of the top sub. The collet may have a first set of teeth. The latch assembly may have a shear pin connecting said the collet to the outer portion of the top sub. The latch assembly may have a recess located on the outer portion of the top sub to allow the collet to collapse into a released position. The latch assembly may also have a second set of teeth configured to engage the first set of teeth. The second set of teeth may be contained on the inner bore of the packer. Instead of the latch assembly, the slurry-depositing assembly may include a locator seal assembly. The locator seal assembly may be partially positioned on the outer portion of the top sub at the second end thereof and may be operable to selectively attach and detach the top sub to the inner bore of the packer.

The slurry-depositing assembly may also include an upper seal and a lower seal. The upper seal may be capable of sealingly engaging with the inner bore of the packer. The lower seal may be capable of sealingly engaging with the inner portion of the circulation valve.

The present invention is also drawn to a method of gravel packing a well completed to a subterranean reservoir. The well may have a production packer, production tubing or casing disposed therein. The production packer, production tubing or casing may have an internal bore. The method involves operatively attaching a gravel-pack assembly to the production packer, production tubing or casing. The gravel-pack assembly may include a gravel-pack packer having an inner bore and a sliding-sleeve valve disposed therein. The sliding-sleeve valve may have an opened position and a closed position. The gravel-pack assembly may also include a gravel-pack screen extending from the gravel-pack packer.

The method may involve lowering a slurry-depositing assembly as described above into the well. A wireline may be used to operatively attach the slurry-depositing assembly to the gravel-pack packer thereby causing the sliding-sleeve valve of the gravel-pack packer to move from the closed position to the opened position. Pumping equipment for the well is provided. Using the pumping equipment, fluid pressure in the well is pressured-up on the inner portion of the container of the slurry-depositing assembly. When a predetermined pressure is reached, the displacement valve of the slurry-depositing assembly may be actuated. Slurry from the inner portion of the container of the slurry-depositing assembly may be displaced to the inner portion of the cross-over tool. The slurry may be displaced through the at least one port of the cross-over tool to the outer portion of the cross-over tool, through the opened sliding-sleeve valve of the gravel-pack packer, and into the well. The slurry may be deposited about the gravel-pack screen in the well. Again, using the wireline, the slurry-depositing assembly may be detached from the gravel-pack packer thereby causing the sliding-sleeve valve of the gravel-pack packer to move from the opened position to the closed position.

The method of the present invention may also include refilling the container of the slurry-depositing assembly with a second batch of slurry and repeating the steps described above until a desired amount of the slurry has been deposited in the well.

The method of the present invention may also include placing the well on production by allowing subterranean fluids and gas to flow through the deposited slurry, through the gravel-pack screen, through the slurry-depositing assembly, and to the surface of the well. The subterranean fluids and gas flowing through the deposited slurry will flow through proppant or gravel-pack sand deposited in the well that was part of the slurry; the liquid component of the slurry will be produced away.

In an alternative embodiment of the method of the present invention, a packer may be lowered into the well. The packer may include an inner bore. A circulation valve may be concentrically disposed in the inner bore of the packer. The circulation valve may have an inner portion and an outer portion. The circulative valve may also have an opened position and a closed position. When lowered into the well, the circulation valve in the packer may be in the closed position. The method involves setting the packer in the well at a desired depth. A wireline may be used to sting a slurry-depositing assembly as described above into the inner bore of the packer. The method includes engaging the outer portion of the shifter member of the slurry-depositing assembly against the inner portion of the circulation valve so that the circulation valve moves from the closed position to the opened position. A predetermined pressure is applied to the piston to shear the at least one shear pin causing the piston to move from the inner portion of the top sub, through the inner portion of the spacer joint, to the inner portion of the shifter member. Slurry may be displaced through the circulation valve and into the well. Again, using wireline, the slurry-depositing assembly is retrieved. Retrieving the slurry-depositing assembly may cause a disengagement of the outer portion of the shifter member from the inner portion of the circulation valve resulting in the circulation valve being set or placed in its closed position.

The alternative embodiment of the method of the present invention may also include refilling the container sub with a second batch of slurry and repeating the above-described steps.

The wireline apparatus and method of the present invention has many advantages over conventional slurry-depositing systems. Because the apparatus operates via wireline (such as electric wireline or slick line), expenses are reduced by eliminating higher costs associated with coiled tubing or work string equipment. The apparatus and method of the present invention permit for a high rate of slurry displacement. Enhanced proppant placement is achieved when compared to conventional systems such as dump bailers. Such enhanced placement creates better perforation filling and inflow performance. The wireline apparatus of the present invention also exhibits a small equipment foot print and achieves economies of scale. The only equipment needed to use the present invention is a wireline unit, single pumping unit and gravel pack tools. Not only is equipment expense reduced, so to are personnel costs and exposure to safety and other risks. The apparatus and method of the present invention require only a wireline crew and gravel pack supervisor. In other words, minimum personnel are necessary to operate the equipment thereby saving costs.

The apparatus and method of the present invention are also advantageous because a variety of slurries may be deposited. The present invention is able to deliver and deposit slurries such as gravel-pack sand, proppants, specialty chemicals used to shut-off water production from subterranean reservoirs, acid treatments, polymers, sealants, resins, cements, and other materials used in oil and gas wells.

The objects and advantages of the present invention including those mentioned above and others will be readily apparent to one skilled in the art to which the invention pertains from a perusal of the claims and the following detailed description of preferred embodiments when read in conjunction with the appended drawings.

DETAILED DESCRIPTION OF THE PREFERRED EMBODIMENTS

Figure 1:
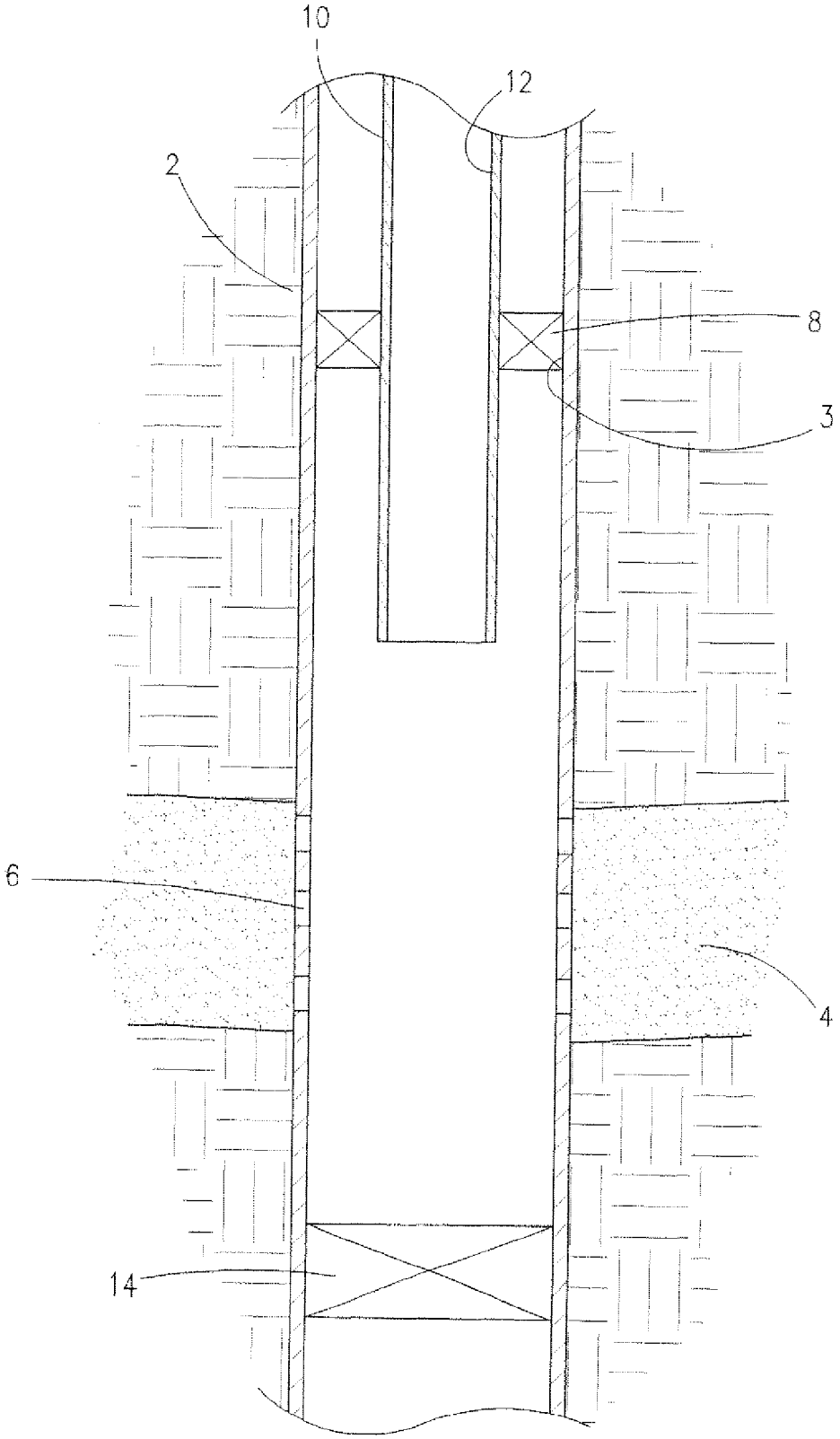
FIG. 1 is a schematic illustration of a completed well with production packer.

With reference to the figures where like elements have been given like numerical designation to facilitate an understanding of the present invention, and with reference to FIG. 1, well 2 has been completed to subterranean reservoir 4. Well 2 has perforations 6 for allowing passage of reservoir fluids and gas as well understood by those of ordinary skill in the art. Production packer 8 is sealingly engaged with inner portion 3 of well 2. Production packer 8 has tubing string 10 operatively attached. Tubing string 10 has internal bore 12 (also referred to as internal portion 12). Bottom plug 14 is also shown.

Figure 2:
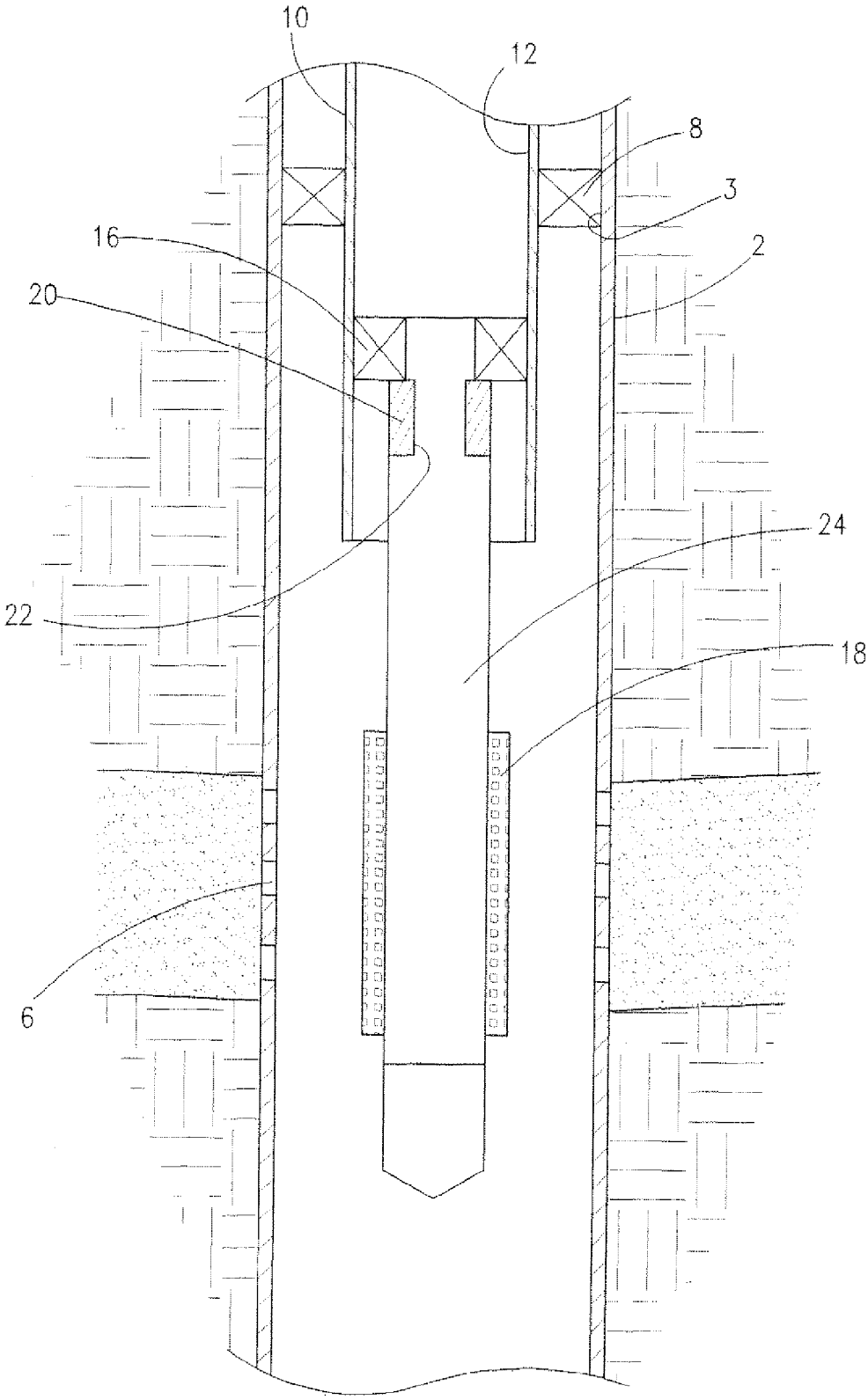
FIG. 2 is a schematic illustration of the well seen in FIG. 1 with an attached gravel-pack packer, blank pipe and gravel-pack screen.

FIG. 2 is a schematic illustration of well 2 seen in FIG. 1 with an attached gravel-pack packer 16 and gravel pack screen 18. Gravel-pack packer 16 is attached to inner bore 12 of tubing 10 and includes gravel-pack perforated extension with inner bore 20 and sliding-sleeve valve 22. Blank pipe 24 connects gravel-pack packer 16 with gravel-pack screen 18. Gravel-pack packer 16 is commercially available from Thru-Tubing Systems, Inc. ("TTS") under the name Paragon™ gravel-pack packer. Gravel-pack screen 18 is commercially available from TTS as part of the Paragon™ gravel-pack packer assembly. Gravel-pack packer 16 and screen 18 are run into well 2, and in particular, tubing 10, and set in inner bore 12 of tubing 10, as is well understood by those of ordinary skill in the art.

Figure 3:
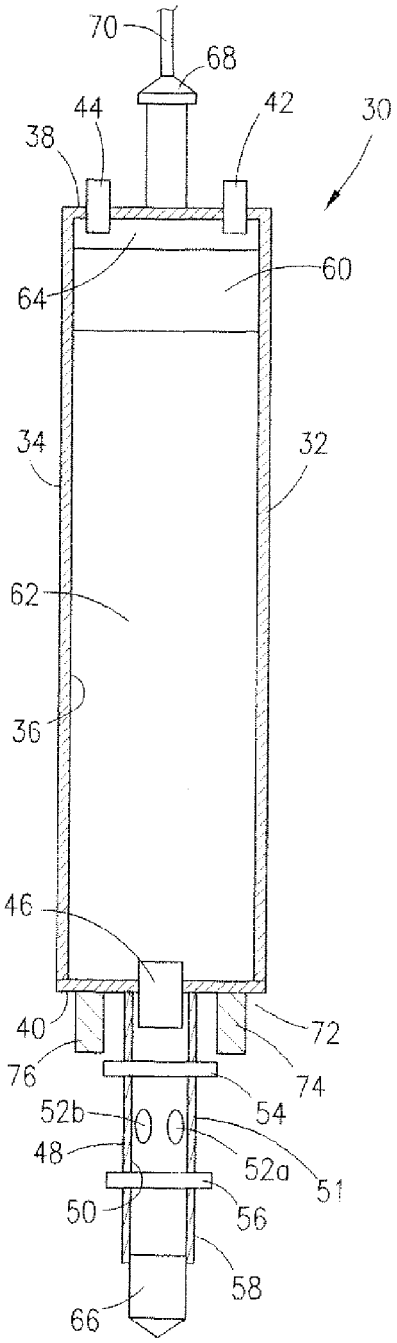
FIG. 3 is a cross-sectional view of one embodiment of the slurry-depositing apparatus of the present invention.

With reference to FIG. 3, slurry-depositing apparatus 30 contains cylindrical container 32 having outer portion 34 and inner portion 36. Inner portion 36 will contain slurry 37 until such time that slurry 37 is deposited in well 2. Container 32 has first end 38 and second end 40. First end 38 contains check valves 42, 43. Check valve 42 allows flow into inner portion 36 of container 32 but not out of inner portion 36 of container 32. Check valve 44 allows flow out of inner portion 36 of container 32 but not into inner portion 36 of container 32. In this way, check valves 42, 44 are set at different pre-determined pressure settings and act to insure the release of an extreme internal pressure within inner portion 36 of container 32. Check valves 44, 46 are commercially available from TTS.

As shown in FIG. 3, displacement valve 46 is operatively associated or attached to second end 40 of container 32. Displacement valve 46 is actuated at a predetermined pressure threshold thereby allowing slurry 37 within inner portion 36 of container 32 to be released. Displacement valve 46 may be any type of valve that is actuated by a predetermined fluid pressure, as for example, a rupture disk. Displacement valve 46 may be a piston actuated when one or more shear pins (e.g., a plurality) holding the piston in place are sheared by the predetermined fluid pressure applied thereto.

Again with reference to FIG. 3, cross-over tool 48 is operatively associated or attached to displacement valve 46. Cross-over tool 48 is adapted to receive slurry 37 on inner portion 50. Cross-over tool 48 is configured to channel slurry 37 from inner portion 50 to outer portion 51 via ports 52*a*, 52*b*. Cross-over tool 48 contains upper seal 54 and lower seal 56. Upper seal 54 will engage and cooperate with inner bore 20 of gravel-pack packer 16. Lower seal 56 will engage and cooperate with sliding-sleeve valve 22. Cross-over tool 48 contains shifting tool 58. Shifting tool 58 cooperates and engages with sliding-sleeve valve 22 in order to open and close sliding-sleeve valve 22.

FIG. 3 depicts piston 60 disposed within inner portion 36 of container 32. Piston 60 creates first chamber 62 and second chamber 64. As tubing annulus pressure is applied to inner portion 36 of container 32, piston 60 acts to push slurry 37 (not shown) from inner portion 36 of container 32 thereby shrinking chamber 62 and expanding chamber 64. Slurry-depositing apparatus 30 terminates with pointy bull plug 66 at one end of cross-over tool 48. On the opposite end, slurry-depositing apparatus 30 contains fishing neck 68 that is connected at one end to container 32 and connected at the other end to wireline 70.

In the embodiment of slurry-depositing apparatus 30 shown in FIG. 3, apparatus 30 contains an anchor assembly 72. Anchor assembly 72 may include latching prongs 74, 76 for latching into receptacle apertures (not shown) on gravel-pack packer 16. Once latched, apparatus 30 is anchored to gravel-pack packer 16 until such time that anchor assembly 72 is released by sufficient pulling force being applied to apparatus 30 via wireline 70.

Figure 4:
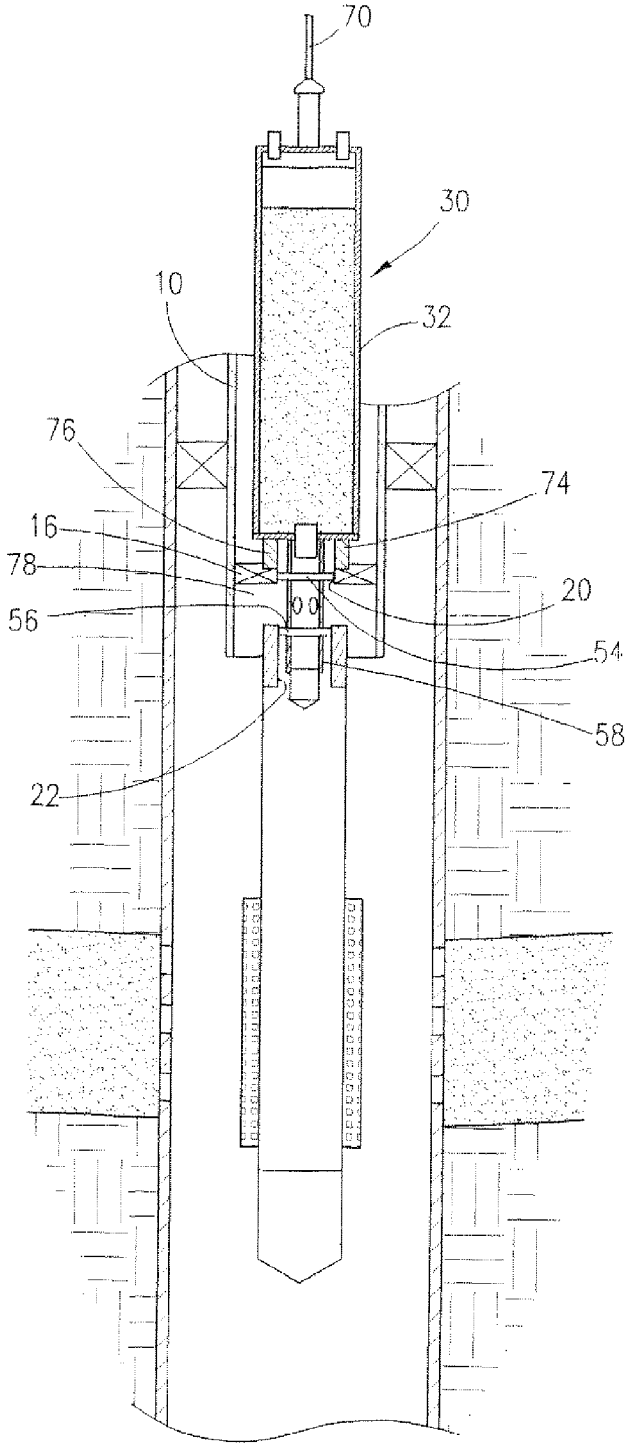
FIG. 4 is a schematic illustration of the slurry-depositing apparatus stung into the gravel-pack packer.

As illustrated in FIG. 4, slurry-depositing apparatus 30 is stung into gravel-pack packer 16. Apparatus 30 has been lowered via wireline 70 to the desired position. Apparatus 30 is anchored into gravel-pack packer 16 via anchoring assembly 72, and in particular, via latching prongs 74, 76. Upper seal 54 sealingly engages with inner bore 20 of gravel-pack packer 16. Lower seal 56 sealingly engages with sliding-sleeve valve 22. As apparatus 30 is set into gravel-pack packer 16, apparatus 30 will open sliding-sleeve valve 22 via shifting tool 58. Passage 78 is formed by the opening of sliding-sleeve valve 22. Slurry 37 (which is a gravel-pack slurry in this embodiment) is held within inner portion 36 of container 32 and more particularly within first chamber 62. Slurry-depositing apparatus 30 is concentrically disposed within tubing 10.

Figure 5:
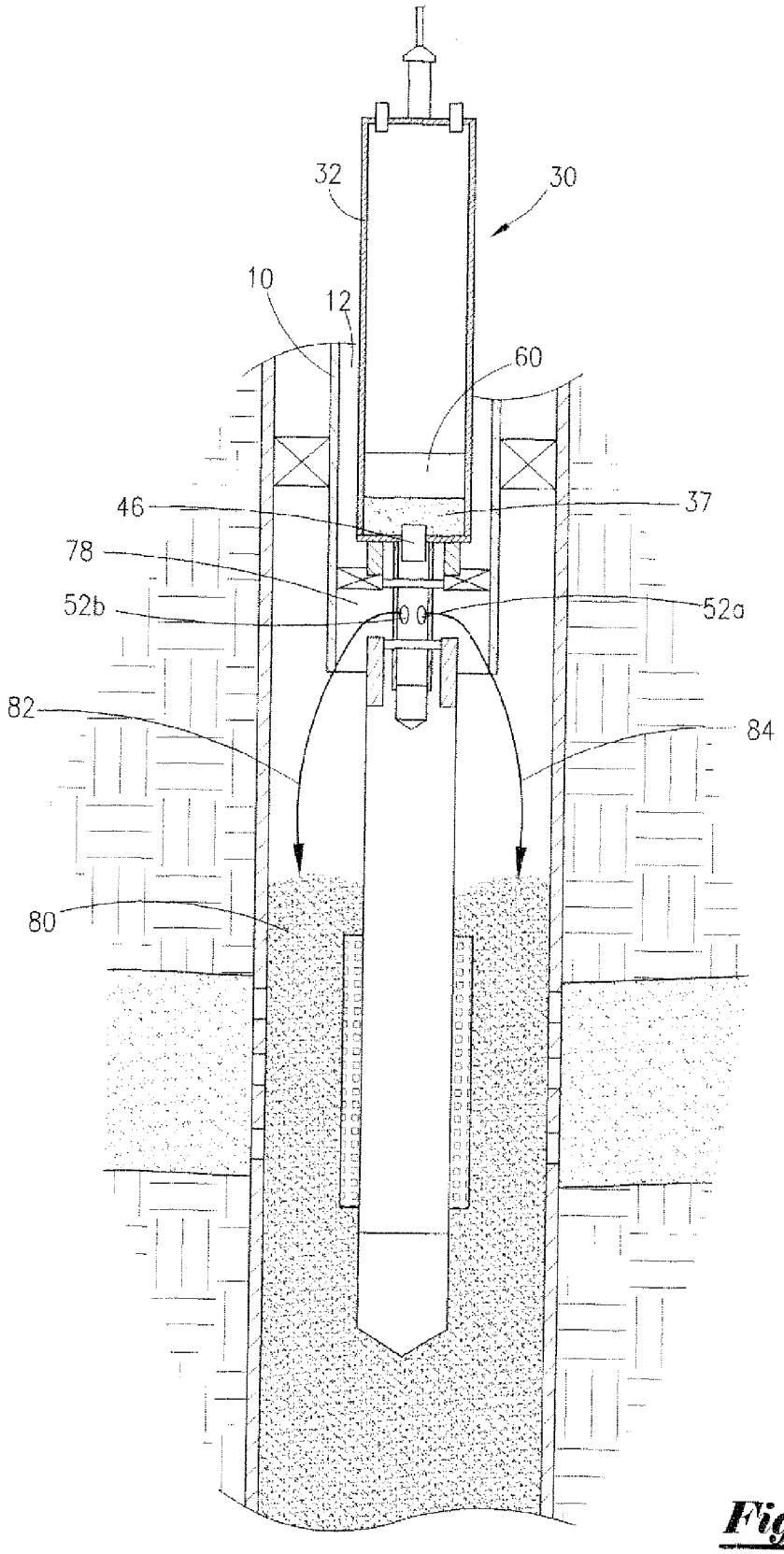
FIG. 5 is a schematic illustration of the slurry-depositing apparatus as seen in FIG. 4 with flow arrows depicting the placement of slurry.

With reference to FIG. 5, a sequential illustration of slurry-depositing apparatus 30 as seen in FIG. 4 is shown with flow arrows depicting the depositing or placement of slurry 37. The operator has applied pressure to inner bore 12 of tubing 10 causing piston 60 to move downward within inner portion 36 of container 32 thereby displacing slurry 37 from inner portion 36 of container 32 as previously described. Pressure is applied at the surface of well 2 using a surface pump. The pressure will actuate displacement valve 46 when a predetermined pressure threshold is achieved thereby causing slurry 37 to exit from inner portion 36 of container 32 (from or through displacement valve 46), travel through cross-over ports 52*a*, 52*b*, through passage 78, and into gravel-pack annulus 80. Arrow 82 and arrow 84 depict slurry 37 flow path to gravel-pack annulus 80.

Figure 6:
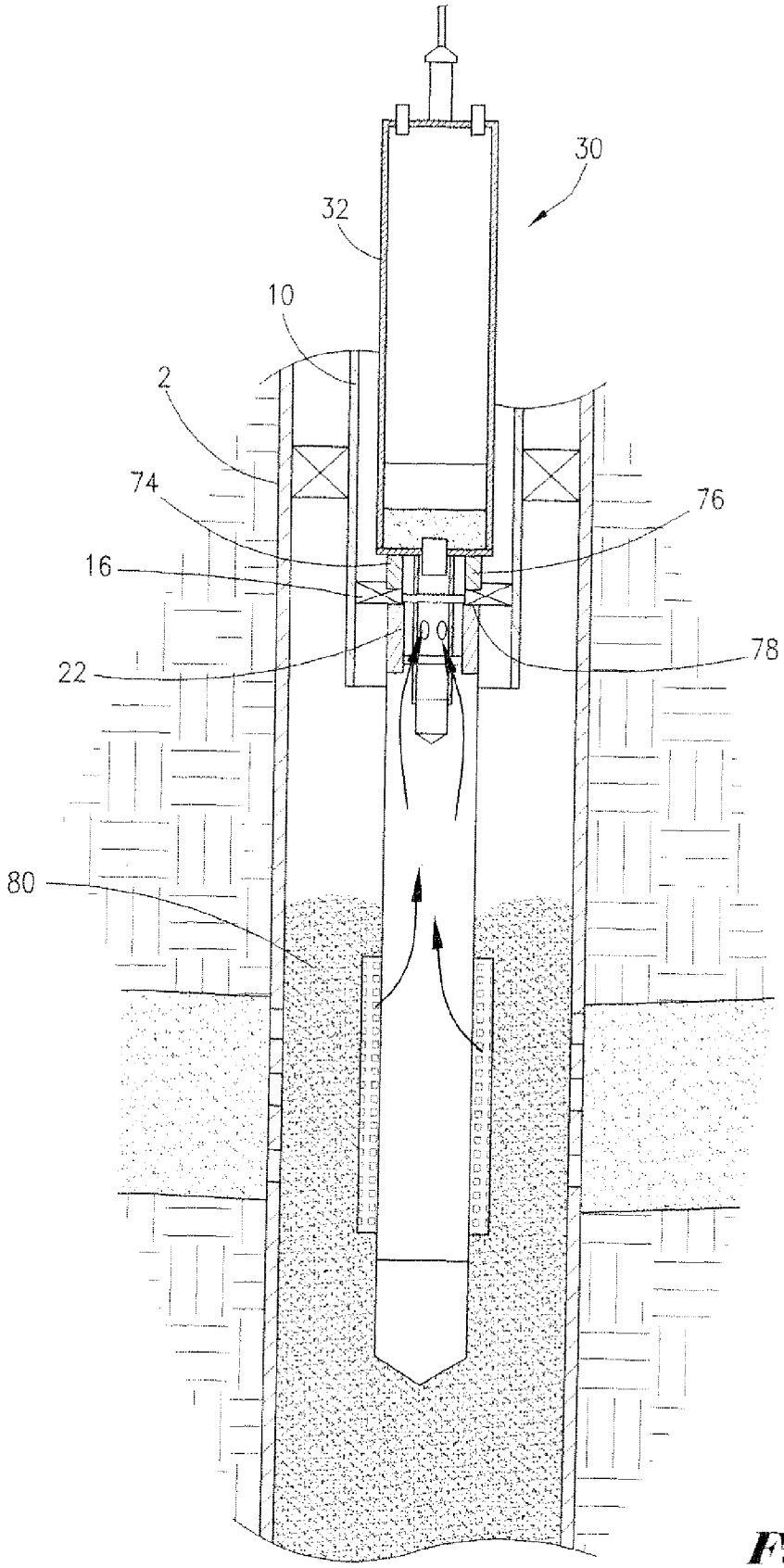
FIG. 6 is a schematic illustration of the slurry-depositing apparatus seen in FIG. 5 being pulled out of the well.

Referring to FIG. 6, slurry-depositing apparatus 30 as seen in FIG. 5 is being pulled out of well 2. After discharging all of slurry 37 from container 32, apparatus 30 may be pulled out of well 2 via wireline 70. Prongs 74, 76 are unlatched from gravel-pack packer 16 due to such pulling force. The step of pulling apparatus 30 out of well 2 simultaneously closes sliding-sleeve valve 22. Passage 78 is again closed. Once apparatus 30 is retrieved from well 2, the operator may refill inner portion 36 of container 32 with a second batch of slurry 37 (more particularly second chamber 62), and reapply by running apparatus 30 back into well 2, stinging into gravel-pack packer 16, pressuring-up on tubing 10, and displacing or exiting the second batch of slurry 37 as previously described. These steps can be repeated until the desired amount of gravel-pack slurry 37 has been delivered to and deposited in gravel-pack annulus 80.

Figure 6A:
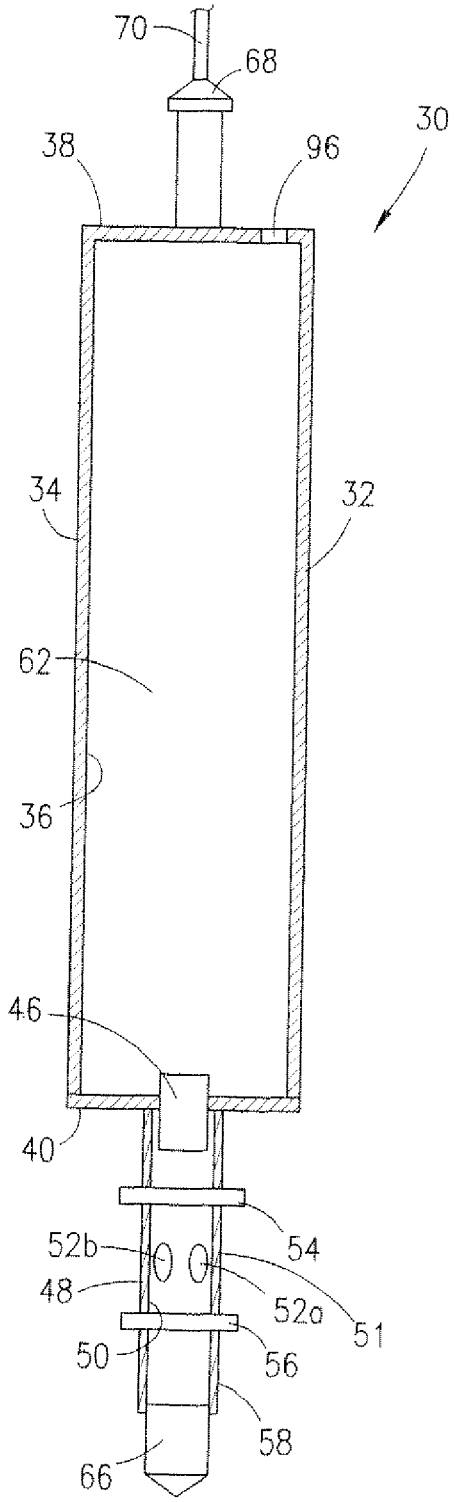
FIG. 6*a* is a schematic illustration of an alternative embodiment of the slurry-depositing apparatus.

FIG. 6*a* illustrates an alternative embodiment of slurry-depositing apparatus 30. In this embodiment, first end 38 of container 32 has port 96. Port 96 permits pressure to be applied to inner portion 36 of container 32. Slurry 37 is contained in inner portion 36 of container 32 while apparatus 30 is operatively connected to gravel-pack packer 16. The operator will know when operative connection of apparatus 30 has been made with gravel-pack packer 16 when certain fluid pressures are achieved. Once operatively connected, the operator will increase the fluid pressure to a predetermined threshold level which will causes the predetermined fluid pressure to be applied to slurry 37 held in container 32 and to displacement valve 46. Displacement valve 46 will be actuated in response to the predetermined pressure thus causing the displacement or exiting of slurry 37 from container 32 as described above and the placement thereof in gravel-pack annulus 80. In this embodiment, apparatus 30 does not include check valves 42, 44, piston 60, and anchor assembly 72 (latch prongs 74, 76).

Figure 7:
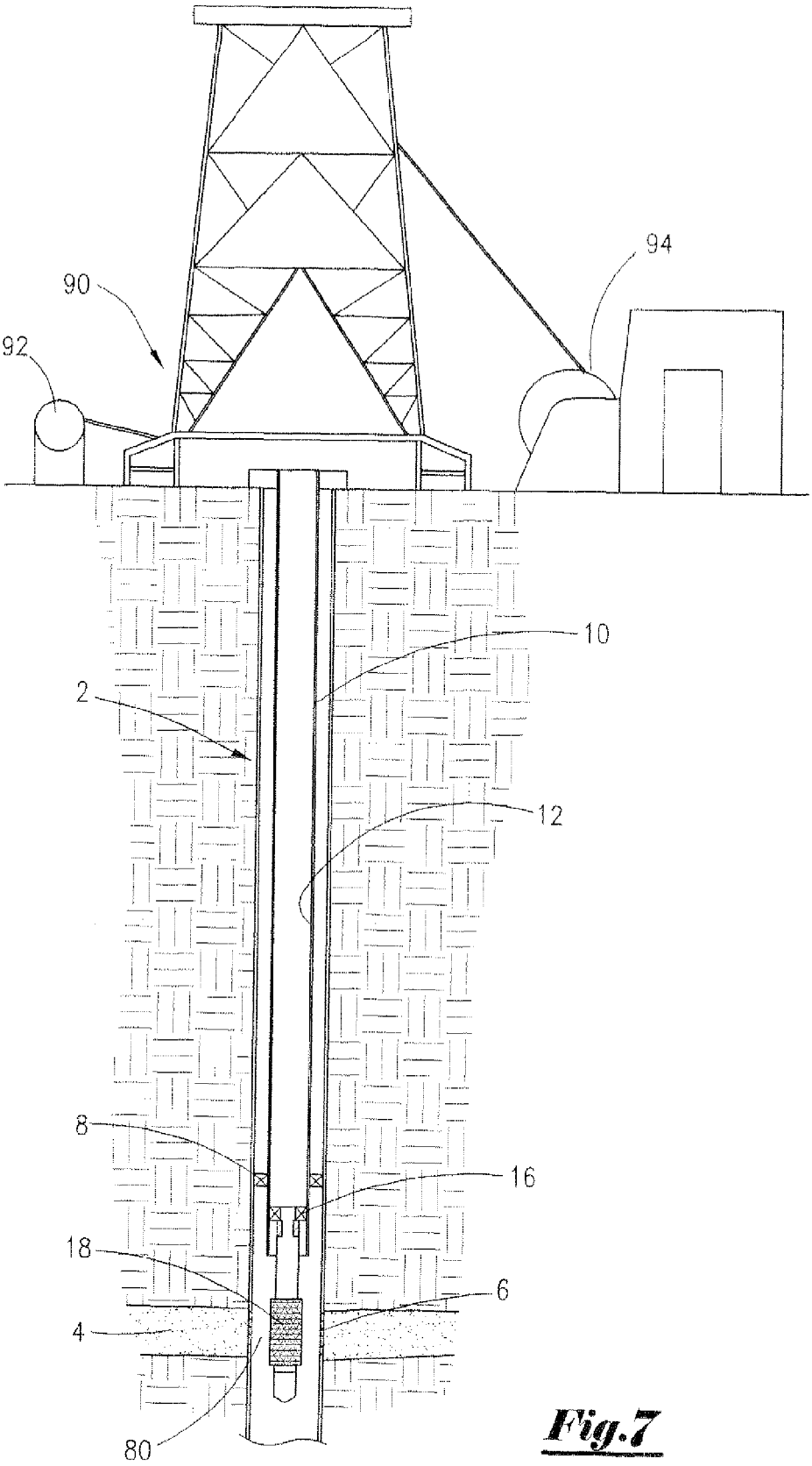
FIG. 7 is a schematic illustration of a well extending from a platform along with the gravel-packing system.
Figure 8A:
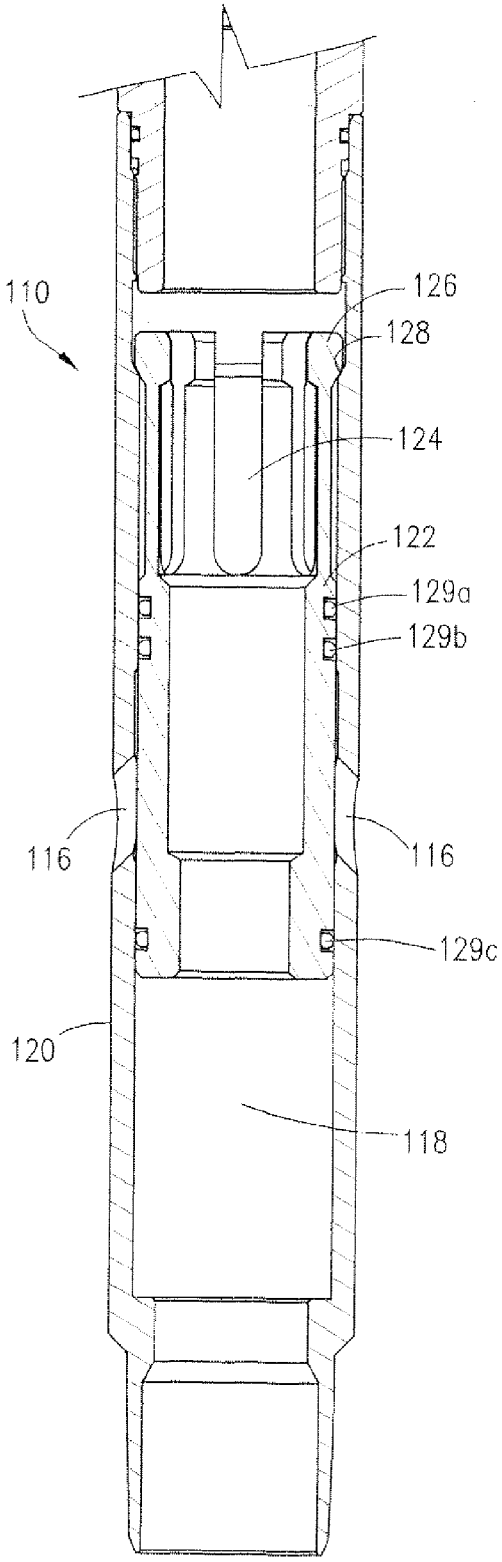
FIGS. 8A-8D are a cross-sectional view of a further embodiment of the present invention showing a packer.
Figure 8B:
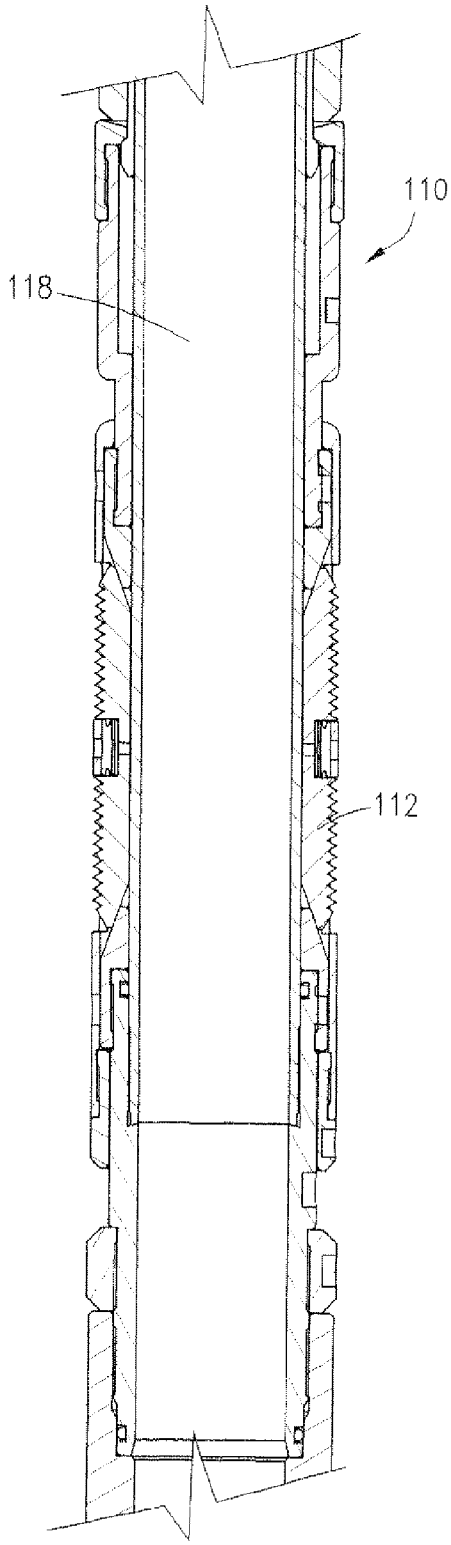
Figure 8C:
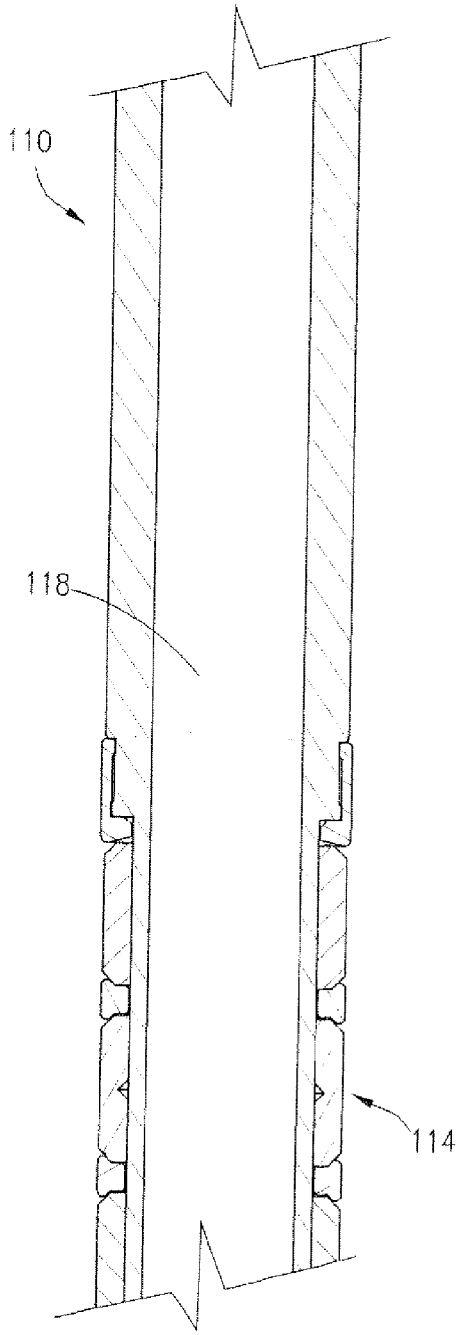
Figure 8D:
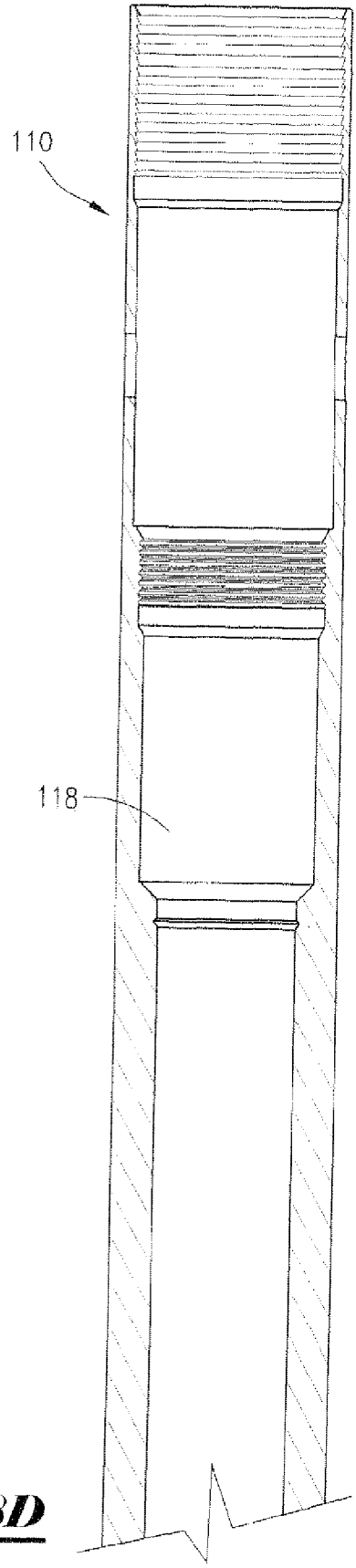
Figure 9A:
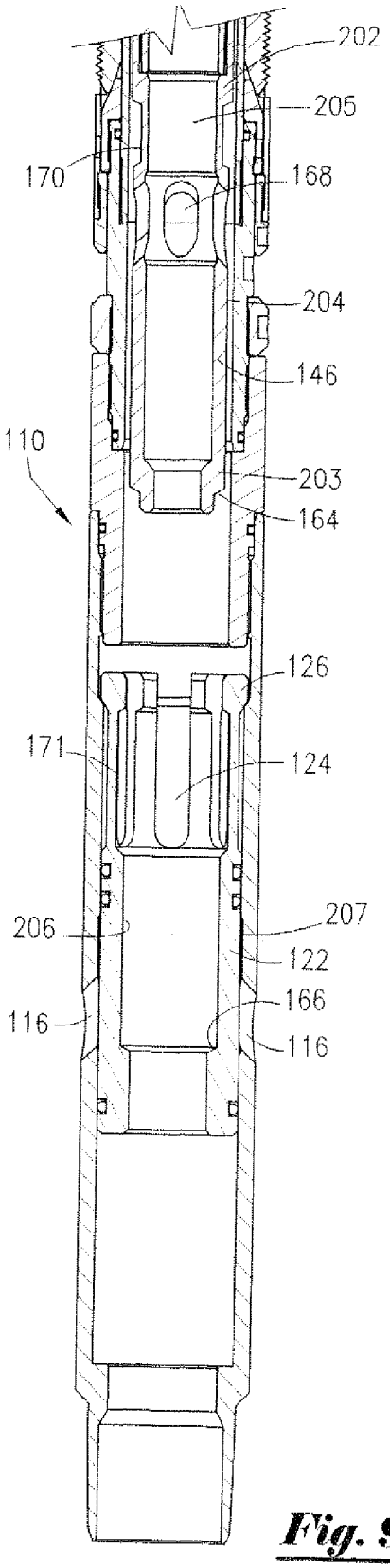
FIGS. 9A-9D are a cross-sectional view of embodiment of FIGS. 8A-8D that includes a slurry-depositing assembly stinging into the packer.
Figure 9B:
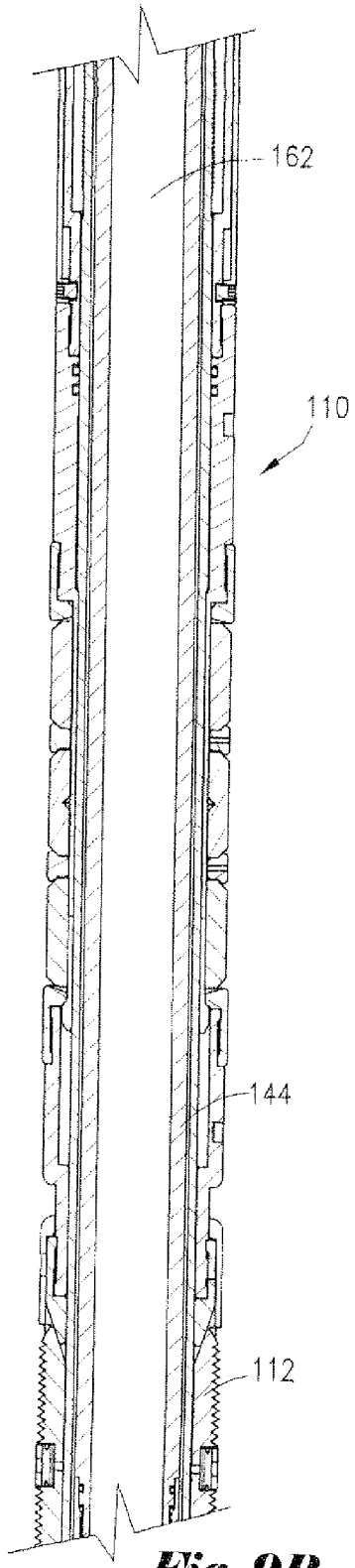
Figure 9C:
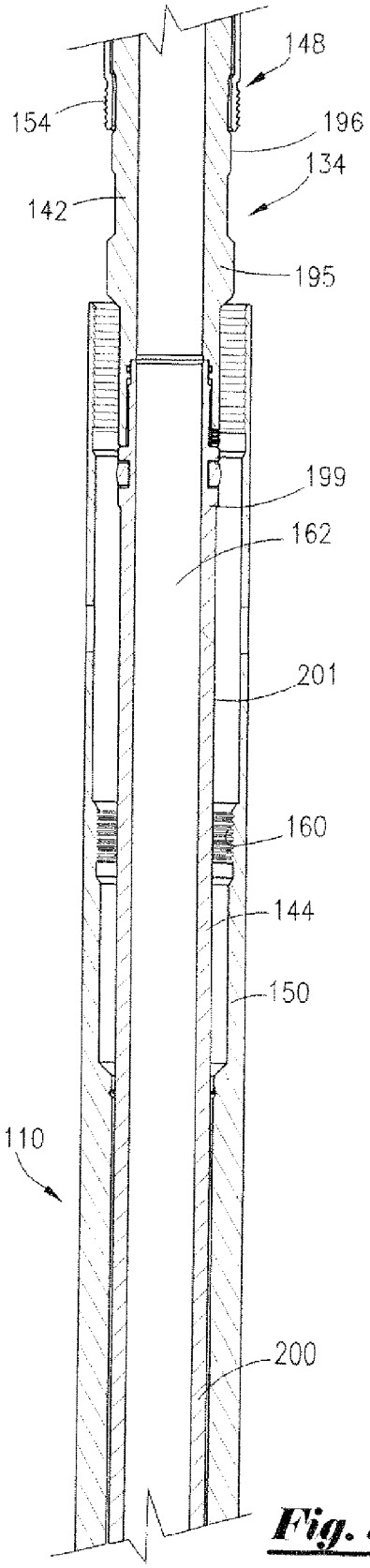
Figure 9D:
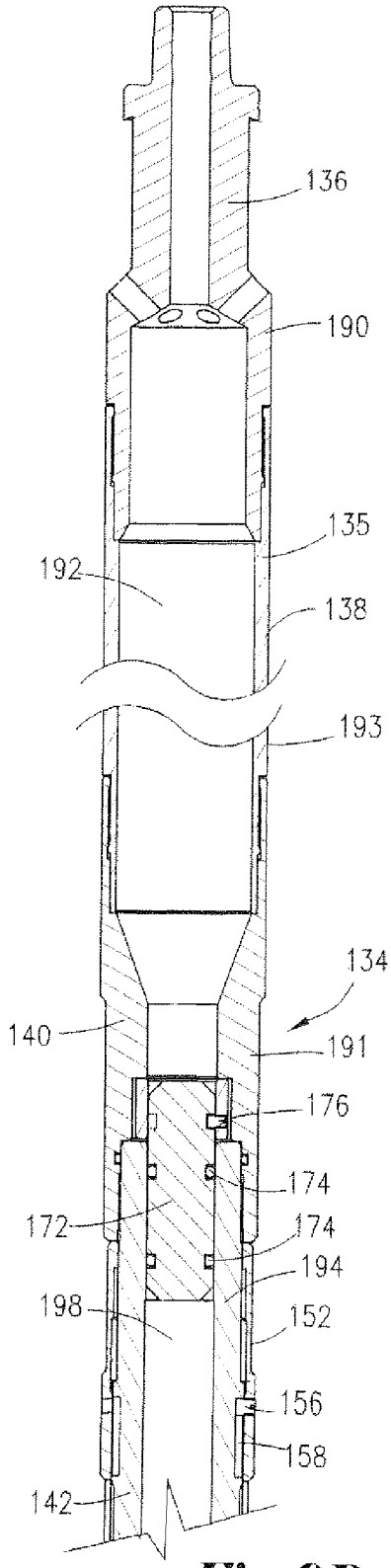
Figure 10A:
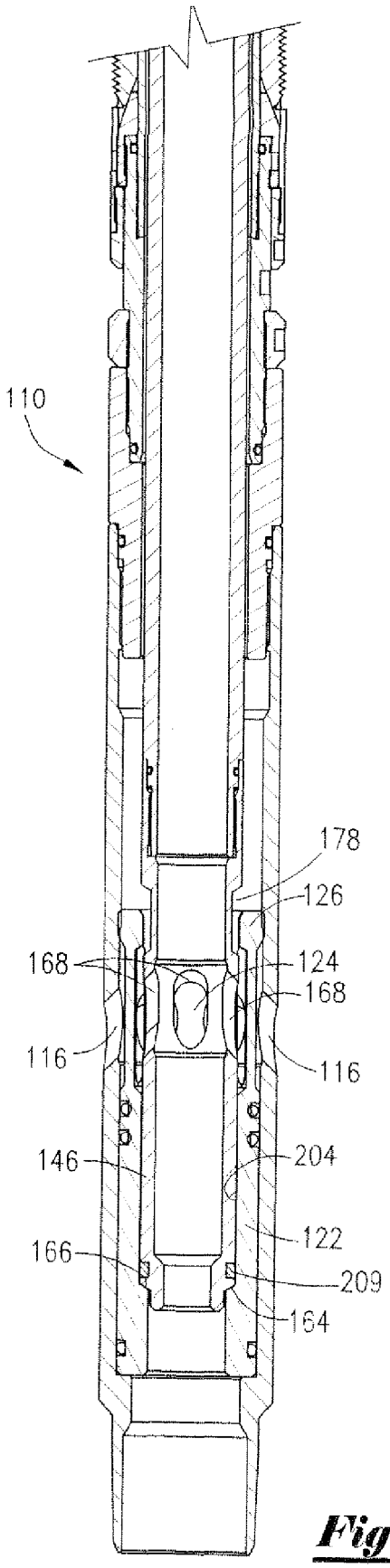
FIGS. 10A-10D are a cross-sectional view of the embodiment seen in FIGS. 9A-9D that includes a slurry-depositing assembly landed in the packer with the circulating valve opened.
Figure 10B:
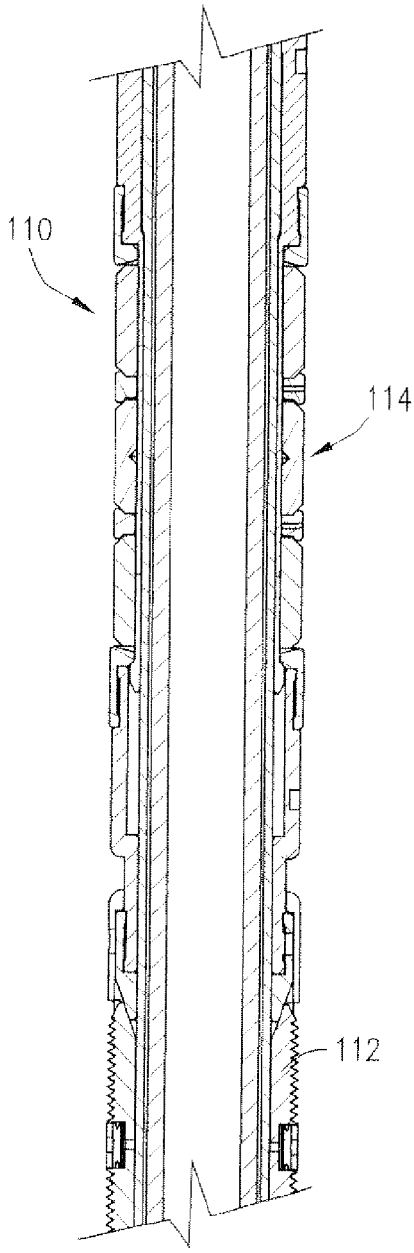
Figure 10C:
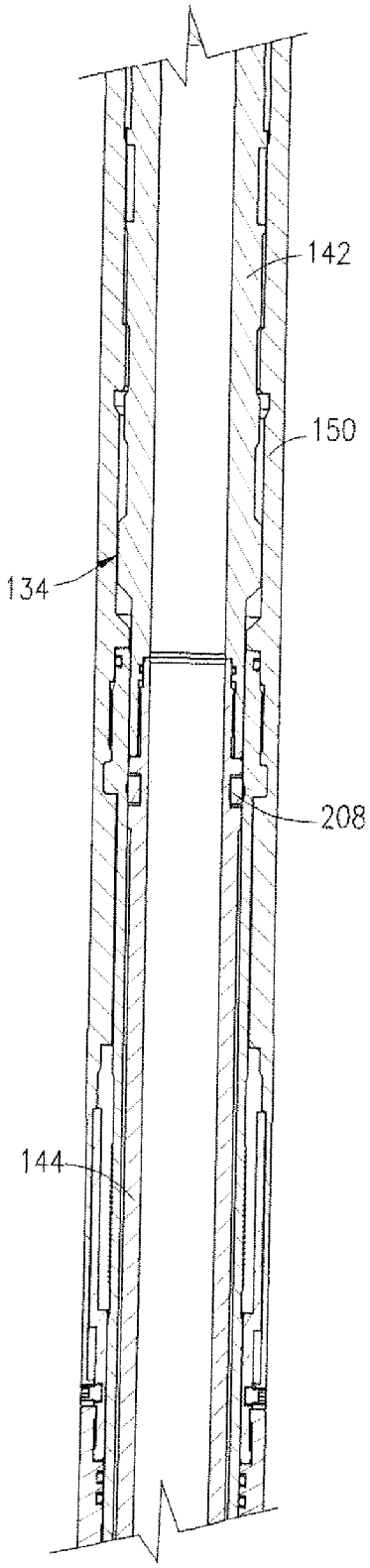
Figure 10D:
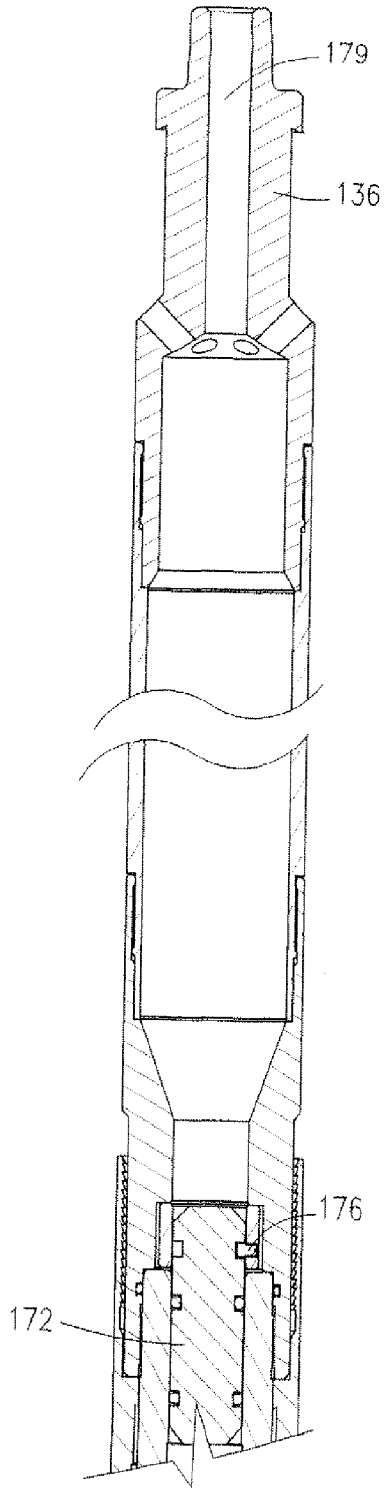
Figure 11A:
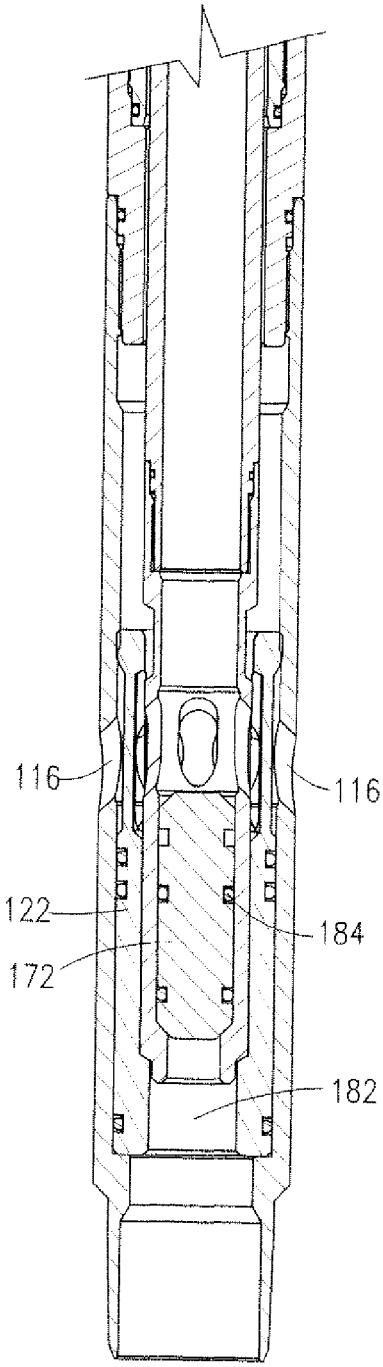
FIGS. 11A-11D are a cross-sectional view of the embodiment seen in FIGS. 10A-10D with pressure being applied to displace the slurry.
Figure 11B:
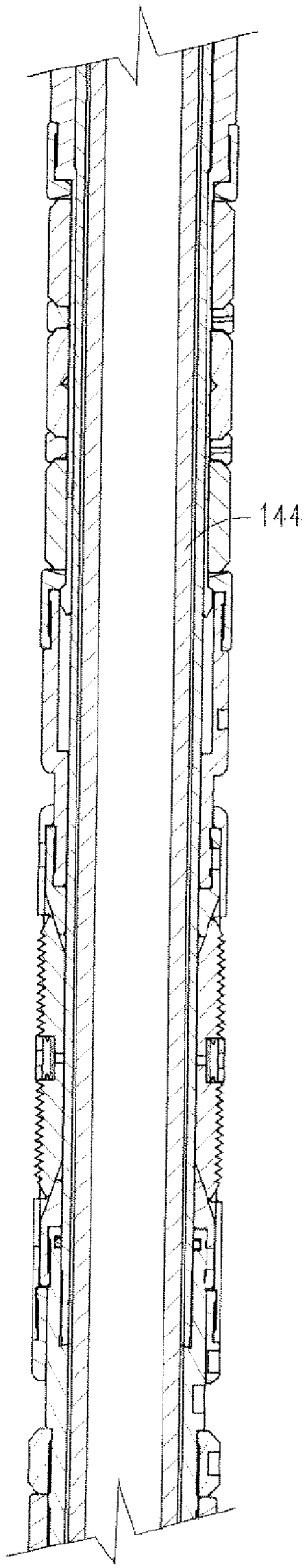
Figure 11C:
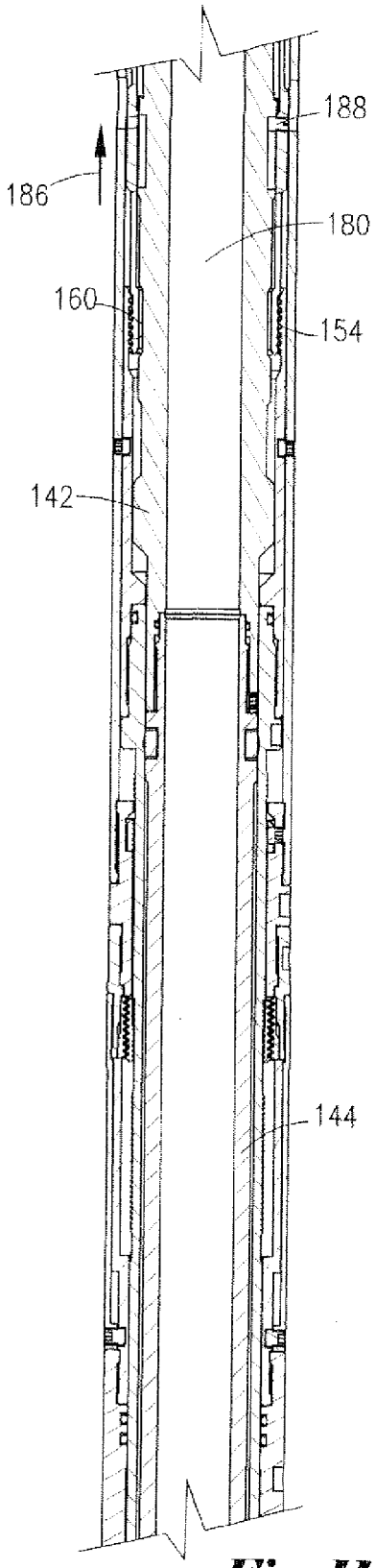
Figure 11D:
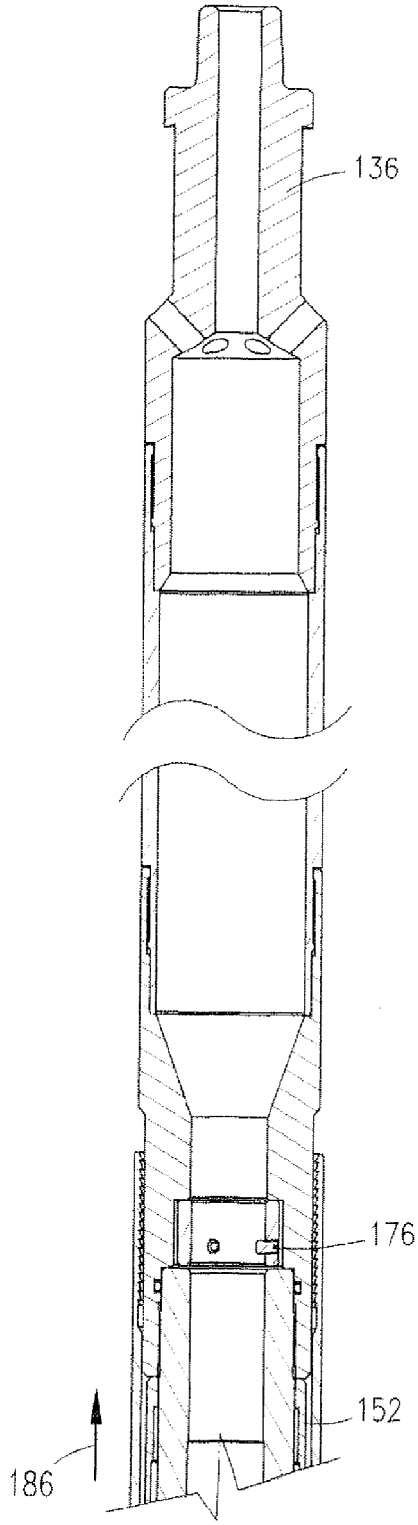
Figure 12A:
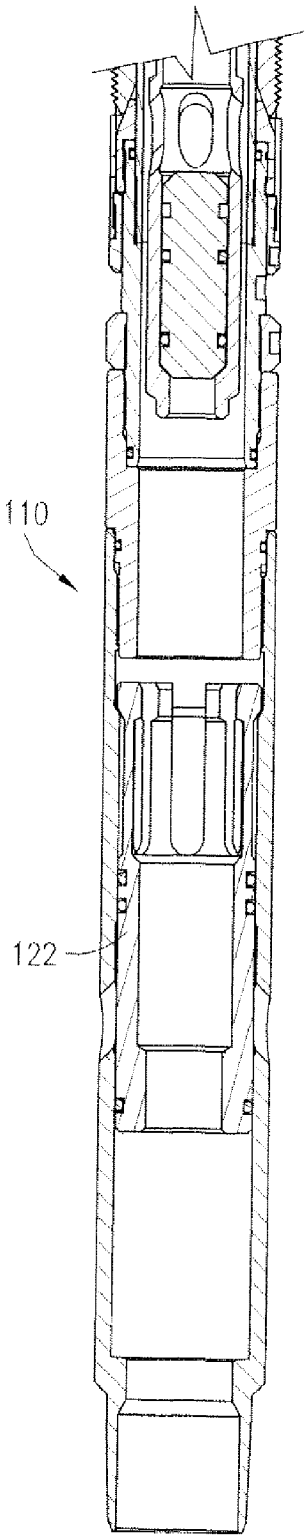
FIGS. 12A-12D are a cross-sectional view of the embodiment seen in FIGS. 11A-11D with the slurry-depositing assembly being pulled from the packer member with the circulation valve closed.
Figure 12B:
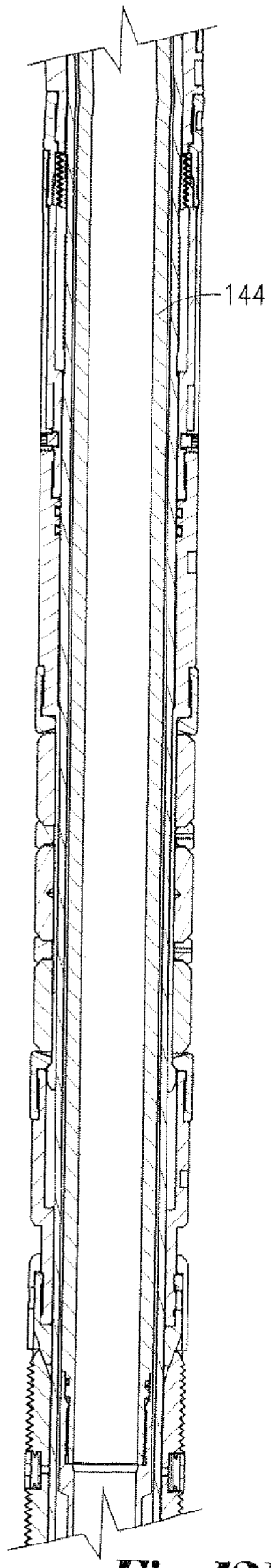
Figure 12C:
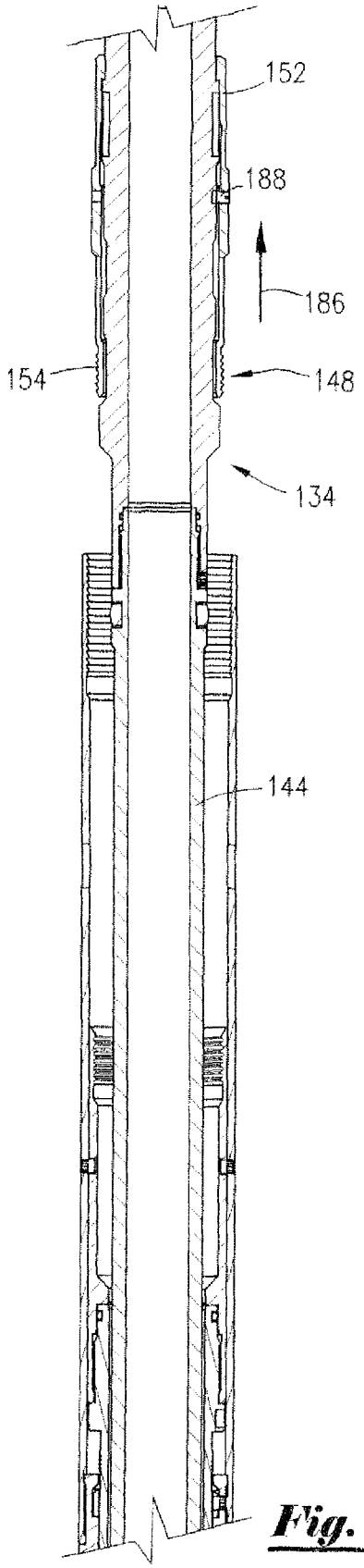
Figure 12D:
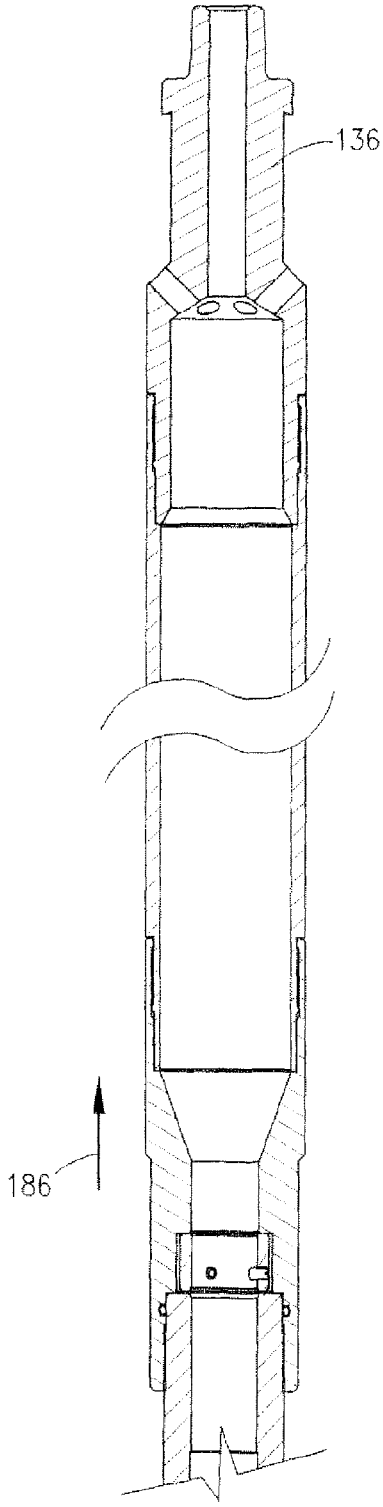

FIG. 7 reveals well 2 extending from platform 90 along with the gravel-packing system of the present invention. Pumping unit 92 is operatively associated with well 2. Wireline unit 94 is operatively associated with tubing 10. Once slurry-depositing apparatus 30 (not shown) is properly set within gravel-pack packer 16 as previously described, pumping unit 92 can pump displacement fluid down internal bore 12 of tubing 10 until slurry 37 is displaced out of container 32 through cross-over tool 48 and into screen annulus 80 and reservoir 4. The operator can continue to repeat this process until screen 18 is covered with gravel-pack slurry 37 and a sand-out pressure is achieved. For well 2 to be placed on production, apparatus 30 is pulled from well 2 (via wireline 70). Fluids and gas from reservoir 4 flow through perforations 6, gravel-pack slurry 37 deposited in gravel-pack annulus 80, gravel-pack screen 18, and up tubing 10 to production surface facilities as understood by those of ordinary skill in the art.

FIGS. 8A-8D, 9A-9D, 10A-10D, 11A-11D, and 12A-12D illustrate an alternative embodiment of the present invention.

Referring to FIGS. 8A-8D, packer 110 is operatively associated or attached to inner portion 3 of well 2 (not shown). Packer 110 includes slips 112 for engaging inner portion 3 of well 2 and seal 114 for sealingly engaging with inner portion 3 of well 2, as understood by those of ordinary skill in the art. Packer 110 contains passage 116. Passage 116 communicates inner portion or bore 118 of packer 110 to outer portion 120 of packer 110. On inner portion 118, circulation valve 122 is slidably disposed. Circulation valve 122 has inner portion 206 and outer portion 207. Circulation valve 122 has openings 124 that will communicate with passage 116. Openings 124 form part of the collets and protuberances 126 that latch circulation valve 122 in place such as seen by protuberance 126 engaged with inner shoulder 128 of packer.

In the position seen in FIGS. 8A-8D, circulation valve 122 is in the closed position so that pressure is not communicated from inner portion 118 to outer portion 120 via passage 116. O-rings 129*a*, 129*b*, and 129*c* prevent the communication of pressure. Packer 110 is commercially available from TTS under the name Series 5000 Paragon™ Packer. Packer 110 is set using a carrier-wireline-setting assembly. The operator would set packer 110 within well 2 at a desired location employing the carrier-wireline-setting assembly and using techniques well understood by one of ordinary skill in the art. Such carrier wireline setting assemblies are commercially available from TTS under the name Multistage.

With reference to FIGS. 9A-9D, slurry-depositing assembly 134 is stung into packer 110. Assembly 134 is generally cylindrical and will be attached to wireline 70 such as an electric wireline or slick line. Slick line is preferred. Assembly 134 includes container sub 135. Container sub 135 has first end 190, second end 191, inner portion 192, and outer portion 193. First end 190 includes fishing neck 136 that contains internal bore 179. Fishing neck 136 is threadedly connected to blank joint 138. Blank joint 138, which in turn is threadedly connected to adapter connector 140, is positioned at second end 191 of container sub 135. Fishing neck 136, blank joint 138 and adaptor connector 140 preferably comprise container sub 135. Inner portion 192 of container sub 135 holds or contains slurry 37 to be deposited in well 2.

FIGS. 9A-9D further show that assembly 134 includes top sub 142. Top sub 142 has first end 194, second end 195, outer portion 196, and inner portion 198. Top sub 142 is operatively associated or connected to second end 191 of container sub 135. More particularly, first end 194 of top sub 142 is threadedly connected to adaptor connector 140 of container sub 135. Top sub 142 extends to spacer joint 144, which itself extends to shifter member 146. Shifter member 146 is configured to engage circulation valve 122. More specifically, shifter member 146 moves circulation valve 122 from an opened to a closed position and from a closed to an opened position.

Spacer joint 144 has first end 199, second end 200, outer portion 201, and inner portion 162. Outer portion 196 of top sub 142 contains latch assembly 148 for latching spacer joint 144 to inner profile portion 150 of packer 110 so that top sub 142 is selectively attachable to inner portion 150 of packer member 110. Latch assembly 148 includes collet 152 disposed about outer portion 201 of spacer joint 144. Collet 152 has first set of teeth 154, shear pin 156 connecting collet 152 to top sub 142, recess 158 located on outer portion 196 of top sub 142 to allow collets 152 to collapse into a released position, and second set of teeth 160 contained on inner profile portion 150 of packer member 110, which are configured to engage first set of teeth 154.

As seen in FIGS. 9A-9D, first end 199 of spacer joint 144 is operatively associated or connected to second end 195 of top sub 142. Second end 200 of spacer joint 144 is operatively associated or connected to shifter member 146 on outer portion 201 of spacer joint 144. Shifter member 146 has first end 202, second end 203, outer portion 204, and inner portion 205. Shifter member 146 has radial shoulder 164 that will engage internal radial shoulder 166 of circulation valve 122. Additionally, shifter member 146 has openings 168 that will cooperate and align with passage 116 and openings 124, and in the open position, will ultimately allow for the passage of slurry 37 from container sub 135 through packer 110 to well 2. Shifter member 146 also contains outer indentation 170 that will cooperate with protuberances 126 of collet 171 of circulation valve 122.

Piston 172 is positioned within inner portion 198 of top sub 142. Piston 172 has seal rings 174 thereon. Shear pin 176 selectively connects piston 172 to top sub 142. Pressure applied to inner portion 192 of container sub 135 will cause shear pin 176 to shear. As illustrated, piston 172 sealingly engages inner portion 198 of top sub 142. Once pressure is applied and shear pin 176 shears, piston 172 will travel down inner portion 198 of top sub 142, inner portion 162 of spacer joint 144 and to inner portion 205 of shifter member 146 thereby permitting slurry 37 to be displaced from container sub 135.

Referring to FIGS. 10A-10D, slurry-depositing assembly 134 is shown landed in packer 110 with circulating valve 122 opened. Radial shoulder 164 of shifter member 146 has engaged radial shoulder 166 of circulation valve 122 so that circulation valve 122 has shifted from the closed position to the opened position. Protuberances 126 engage recess 178 of outer portion 204 of shifter member 146. Passage 116, openings 124 and the openings 168 are aligned. Assembly 134 is shown with upper seal ring 208 in spacer joint 144 that sealingly engages with inner portion 118 of packer 110. Assembly 134 is also shown with lower seal ring 209 in shifter member 146 that sealingly engages with inner portion 206 of circulation valve 122.

FIGS. 11A-11D depict cross-sectional views of the assembly seen in FIGS. 10A-10D with pressure being applied to displace slurry 37. More particularly, pressure has been applied to inner portion 192 of container sub 135. The pressure acts on piston 172. Once sufficient pressure acts on piston 172, shear pin 176 shears thereby allowing piston 172 to sealingly move through top sub 142, through spacer joint 144 and to shifter member 146 thereby forming first chamber 180 and second chamber 182. Note that second chamber 182 is at a minimum in this view. Piston 172 contains seal 184 on its outer portion. The application of pressure causes slurry 27 to be displaced from first chamber 180, through circulation valve 122, and out passage 116 into well 2.

Again with reference to FIGS. 11A-11D, a pull (such as from wireline 70) initiated by the operator from the surface in the direction of arrow 186 (seen in FIG. 11D) will cause collet 152 to be forced in the same direction, which is transferred to first set of teeth 154 (seen in FIG. 11C). Since first set of teeth 154 and second set of teeth 160 are engaged, the pull force will be resisted until a predetermined amount of force is exerted in order to shear shear pin 188. Once this predetermined amount of force is exerted and shear pin 188 shears, collet 152 will slide down outer portion 196 of top sub 142 thereby allowing first set of teeth 154 to collapse, which in turn disengages first set of teeth 154 from second set of teeth 160.

Referring to FIGS. 12A-12D, slurry-depositing assembly 134 is shown being pulled from packer 110 with circulation valve 122 closed. The pull from the operator on the surface will be in the direction of arrow 186. Once assembly 134 is at the surface, the operator can refill container sub 135 and repeat the above process until the desired amount of material has been deposited within well 2.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A wireline apparatus for depositing a slurry in a well, the apparatus comprising:

a container having a first end, a second end, an outer portion, and an inner portion, said inner portion capable of containing slurry to be deposited in said well, said second end of said container capable of being operatively attached to and detached from a packer;

a displacement valve positioned at said second end of said container, said displacement valve actuated by a predetermined fluid pressure applied thereto; and a cross-over tool operatively associated with said displacement valve, said cross-over tool having an outer portion, an inner portion, and at least one port; wherein actuation of said displacement valve causes said slurry to enter said inner portion of said cross-over tool and pass through said at least one port to said outer portion of said cross-over tool and into said well;

wherein said second end of said container includes a locator seal assembly, said locator seal assembly capable of operatively attaching to and detaching from said packer.

2. The wireline apparatus according to claim 1, wherein said displacement valve is a piston.

3. The wireline apparatus according to claim 2, wherein said piston is held in place by a holding means.

4. The wireline apparatus according to claim 3, wherein said holding means is at least one shear pin, said at least one shear pin being actuated by a shearing thereof when said predetermined fluid pressure is applied to said piston.

5. The wireline apparatus according to claim 2, wherein said displacement valve is a spring-loaded check valve.

6. The wireline apparatus according to claim 1, wherein said first end of said container has at least one port capable of causing fluid pressure to be exerted on said slurry contained within said inner portion of said container.

7. The wireline apparatus according to claim 1, wherein said second end of said container further includes an anchor assembly, said anchor assembly capable of operatively attaching to and detaching from said packer and wherein said anchor assembly includes at least one latching prong.

8. The wireline apparatus according to claim 1, wherein said packer includes an inner bore and a sliding-sleeve valve positioned therein, said sliding-sleeve valve having an opened and a closed position, and wherein said wireline apparatus further comprises a shifting tool positioned on said outer portion of said cross-over tool, said shifting tool capable of actuating said sliding-sleeve valve to said opened position when said second end of said container is operatively attached to said packer and capable of actuating said sliding-sleeve to said closed position when said second end of said container is operatively detached from said packer.

9. The wireline apparatus according to claim 8, wherein said cross-over tool includes an upper seal and a lower seal, said upper seal capable of sealingly engaging with said inner bore of said packer, said lower seal capable of sealingly engaging with said sliding-sleeve valve.

10. The wireline apparatus according to claim 8, wherein said packer includes a seal and said sliding-sleeve valve includes a seal, said seals each capable of sealingly engaging with said cross-over tool.

11. The wireline apparatus according to claim 1, wherein said first end of said container includes a first check valve for allowing fluid flow into said inner portion of said container and a second check valve for allowing fluid flow out of said inner portion of said container.

12. The wireline apparatus according to claim 1, wherein said inner portion of said container includes a first chamber and a second chamber, said first and second chambers being separated by a movable piston, said second chamber operable to contain said slurry for deposit in said well.

13. The wireline apparatus according to claim 1, wherein said container is cylindrical.

14. The wireline apparatus according to claim 13, wherein said cylindrical container is adapted to be run into said well on said wireline.

15. The wireline apparatus according to claim 14, wherein said wireline is an electric line capable of transmitting an electrical signal.

16. The wireline apparatus according to claim 14, wherein said wireline is a slick line cable.

17. The wireline apparatus according to claim 1, wherein said slurry is selected from the group consisting of surfactants, acids, polymers, resins, sealants, and gravel pack slurries.

18. The wireline apparatus according to claim 1, wherein said packer is a gravel-pack packer sealingly engaging an internal bore of a production tubing disposed in said well.

19. The wireline apparatus according to claim 18, wherein said slurry is a gravel pack slurry.

* * * * *